United States Patent [19]

Barnes et al.

[11] Patent Number: 4,664,702

[45] Date of Patent: May 12, 1987

[54] METHOD OF MELTING ALUMINUM IN A VERTICAL SHAFT FURNACE

[75] Inventors: David Barnes, Carrollton; Joseph A. Bass, Bremen; John D. Butler, Roopville; Robert H. McKenzie, Carrollton, all of Ga.

[73] Assignee: Southwire Company, Carrollton, Ga.

[21] Appl. No.: 697,605

[22] Filed: Feb. 4, 1985

[51] Int. Cl.[4] ..... C22B 21/00

[52] U.S. Cl. ..... 75/68 R; 266/236; 266/900

[58] Field of Search ..... 75/65 R, 68 R; 266/200, 266/900, 901, 236

[56] References Cited

U.S. PATENT DOCUMENTS

| | | | |
|---|---|---|---|
| 3,383,099 | 5/1968 | Rehder | 266/901 |
| 3,663,203 | 5/1972 | Davis et al. | 266/900 |

FOREIGN PATENT DOCUMENTS

| | | | |
|---|---|---|---|
| 2553697 | 6/1977 | Fed. Rep. of Germany | 266/900 |
| 395686 | 1/1974 | U.S.S.R. | 266/900 |

*Primary Examiner*—Melvyn J. Andrews

*Attorney, Agent, or Firm*—Herbert M. Hanegan; Stanley L. Tate

[57] ABSTRACT

A method of efficiently melting aluminum and aluminum alloys in a vertical shaft furnace substantially completely by convection is disclosed. The vertical shaft furnace has a generally cylindrical cross-section with a refractory liner and a cast refractory hearth having a concave, generally conical shape. A plurality of downwardly inclined burners are provided in the walls of the furnace arranged in such a way as to prevent the high velocity burner flame from blowing the aluminum material to be melted across the furnace and into burners on the opposite furnace wall.

9 Claims, 5 Drawing Figures

METHOD OF MELTING ALUMINUM IN A VERTICAL SHAFT FURNACE

BACKGROUND OF THE INVENTION

The present invention relates to methods of melting metal and, more particularly, to a method of melting aluminum and aluminum alloys in a vertical shaft furnace.

It is well-known to melt ferrous and some non-ferrous metals, such as copper, in vertical shaft furnaces as exemplified by the furnaces disclosed in the following U.S. patents and the patents cited therein:

U.S. Pat. No. 2,283,163
U.S. Pat. No. 3,199,977
U.S. Pat. No. 3,715,203
U.S. Pat. No. 3,759,699
U.S. Pat. No. 3,788,623
U.S. Pat. No. 4,129,742
U.S. Pat. No. 4,243,209
U.S. Pat. No. 4,311,519
U.S. Pat. No. 4,315,755
U.S. Pat. No. 4,375,352

Another known furnace which is said to be useful for melting aluminum is disclosed in U.S. Pat. No. 3,809,378. The furnace disclosed in that patent comprises the combination of a primary melting chamber with a vertical flue and a secondary melting chamber connected to the primary melting chamber. Heat is transferred to the metal in the primary melting chamber by convection where it is "half-melted" using a high velocity burner. Thereafter, the "half-melted" metal flows to the secondary melting chamber where it is completely melted by radiant heat.

Typically, aluminum and aluminum alloys are melted in a reverberatory furnace which differs from a vertical shaft furnace primarily in the manner in which heat is transferred to the aluminum metal. In a reverberatory furnace, heat is transferred to the metal to be melted mainly by radiation from the walls of the furnace, and to a lesser extent, by conduction of heat from molten metal to solid metal. Heat transfer to the metal in a shaft furnace, on the other hand, is primarily by way of convection, only a negligible amount of heat being transferred by either radiation from the furnace walls or by conduction.

In metal melting applications, it is generally known that shaft furnaces are about twice as efficient as reverberatory furnaces in terms of gas consumption rates per unit weight of metal melted in BTU/lb. However, shaft furnaces do not appear to have been utilized to any significant extent in the aluminum industry for melting aluminum and aluminum alloys.

It has been found that one problem associated with melting aluminum or aluminum alloy metals by convection in a shaft furnace using conventional, high velocity burners is the tendency for the low density aluminum metals, especially aluminum in small scrap form, to be "blown" by high velocity gas impingement against the walls of the furnace rather than falling by gravity onto the furnace hearth. In addition, it has been found that molten, semi-molten, and solid aluminum metal can also be "blown" by the high velocity burner gases into other burners and burner openings disposed about the furnace wall, thereby causing furnace inefficiency, potential burner blockages, and significantly increasing furnace maintenance costs.

One way of overcoming the aforementioned problem is to substantially reduce burner velocity. However, melting rate is directly proportional to burner velocity, and it is highly preferred that burner velocity be maximized according to the type and shape of the aluminum material to be melted.

Another way of overcoming the problem of "blowing" the aluminum metal is to utilize the furnace of the aforementioned U.S. Pat. No. 3,809,378, which has only a single high velocity burner directed diametrically across the primary melting chamber toward the opening into the secondary melting chamber. Thus, any molten, semi-molten or solid aluminum metal "blown" across the primary melting chamber by the high velocity burner gases is directed into the secondary melting chamber of reverberatory portion of the furnace where it is subjected to heating and melting under less than optimum heat transfer conditions, i.e., radiant heating in lieu of convection heating.

Another problem associated with melting aluminum metals in a reverberatory furnace is the risk of explosion resulting from moisture contamination of the metal charged to the furnace. Should any moisture be entrapped in the metal when it is charged to a hot furnace containing a molten pool of aluminum, i.e., a "wet" hearth, the moisture is likely to flash into steam with a resulting expansion in volume that may cause a potentially dangerous explosion. The possibility of such an explosion in a shaft furnace is highly remoted because a shaft furnace is typically a "dry" hearth furnace and because the metal is charged to the furnace at the top of the shaft where it is preheated by convection, which advantageously evaporates all moisture from the charge.

SUMMARY AND OBJECTS OF THE INVENTION

In view of the foregoing limitations and shortcomings of the prior art furnaces as well as other disadvantages not specifically mentioned above, it should be apparent that there still exists a need in the art for an improved method of melting aluminum and aluminum alloys by convection in a vertical shaft furnace. It is, therefore, a primary objective of the present invention to fulfill that need by providing a method of melting aluminum alloy metals in a vertical shaft furnace employing a novel and improved arrangement of burners mounted in the side walls of the furnace, said burners being uniquely oriented with respect to the metal charge and the furnace hearth to eliminate or minimize the problems associated with melting aluminum and aluminum alloys with high velocity burners in a shaft furnace.

More particularly, it is an object of the present invention to provide a method of melting aluminum and aluminum alloy metals in a vertical shaft furnace having a plurality of downwardly inclined burners mounted in the sidewalls of the furnace with each burner axis oriented to impinge upon a portion of the furnace hearth to keep the hearth hot and to avoid blowing the aluminum metal across the furnace.

It is another object of the invention to provide a method of melting aluminum and aluminum alloy metals wherein heat transfer to the metal is achieved substantially completely by convection rather than by radiation.

Another object of this invention is to provide a method of melting aluminum and aluminum alloy metals in a vertical shaft furnace in which the heat input for completely melting an aluminum charge ranges from as low as 600 up to 1500 BTU per pound with an average heat input of about 1000 BTU per pound or less.

Still another object of the present invention is to provide a method of melting aluminum and aluminum alloy metals in a vertical shaft furnace having a concave, steeply sloped hearth designed to permit the molten metal to flow rapidly from the furnace hearth and, thus, avoid forming a pool or bath of molten aluminum on the furnace hearth.

Yet another object of this invention is to provide a method of melting aluminum and its alloys a vertical shaft furnace which can be rapidly started up from a cold condition and even more rapidly shut down.

Another object of the invention is to provide a method of melting aluminum and aluminum alloy metals in a vertical shaft furnace capable of melting a variety of types and shapes of aluminum materials, such as small aluminum scrap, aluminum beverage cans, 30-pound aluminum ingots or pigs, and 1,000- and 2,000-pound aluminum sows.

Another object of the invention is to provide a highly efficient method of melting aluminum and aluminum alloy metals substantially completely by convection in a vertical shaft furnace.

Briefly described, the aforementioned objects are accomplished according to the method of the invention by providing a vertical shaft furnace having a generally cylindrical cross-section, the walls of the furnace being constructed of a suitable refractory material, such as, for example, silicon carbide brick backed by heavy-duty fire brick, and castable insulation, all encased in a cylindrical steel shell. The furnace has unique cast refractory hearth having a concave, generally conical shape which is steeply sloped toward an outlet trough extending radially outwardly from the lowermost elevation of the hearth. A plurality of burner openings are provided in the walls of the furnace, the number of rows of burners and the number of burners in each row being dependent on the design capacity of the furnace and, to some extent, on the type of aluminum material to be melted in the furnace.

A refractory-lined tunnel, having an arcuate roof is interconnected with the vertical shaft furnace adjacent the hearth in superposed relation over the outlet trough. The innermost end of the tunnel intersects the cylindrical wall of the furnace, and the outermost open end of the tunnel is closed by an access door mounted for pivotable movement to open and closed positions over the open end of the tunnel remote from the furnace. A burner is mounted in the center of the access door such that, in the closed position of the door, the burner flame is downwardly inclined so as to impinge along the centerline of the outlet trough.

The arrangement of the first or lowermost row of burners in the furnace adjacent the hearth is important for achieving certain of the objectives of the invention. In the preferred embodiment described hereinafter, there are four burners arranged in non-equiangular spaced relation about the furnace wall. The two burners remote from the outlet trough are arranged with their axes offset about 35° clockwise and counterclockwise, respectively, from a vertical plane passing through the shaft axis and the centerline of the outlet trough, while the two burners is closer proximity to the outlet trough are arranged with their axes offset about 60° clockwise and counterclockwise, respectively, from such vertical plane.

The axes of the first row of four burners in the described embodiment are disposed in vertical planes which intersect at a point offset from the geometrical axis of the cylindrical shaft of the furnace in a direction along the vertical plane through the centerline of the outlet trough. The orientation of the burner axes as above-described provides a flow of hot, relatively high velocity gases which advantageously directs the molten aluminum metal on the hearth toward the outlet trough.

Each of the four burners in the first row is downwardly inclined so that its axis generally coincides with the slope of the conical portion of the hearth immediately underlying such burner. In the disclosed embodiment, the conical slope of the hearth and downward inclination of the burner axes from the horizontal are both approximately 30°. Because the concave hearth also slopes downwardly toward the outlet trough, the height of the two burners located adjacent the outlet trough is lower than the height of the other two burners remote from the trough so that the heights of the burner flames above the hearth surface are all approximately uniform.

Each of the burners in the first row of burners in the described embodiment is downwardly oriented and positioned in a respective burner opening so that its flame is directed generally at one quadrant of the concave portion of the hearth. Moreover, as previously mentioned, the burner axes are not equiangularly spaced about the furnace wall, but are positioned so that their axes are disposed in different, non-coincident, but intersecting, planes.

The above-described combination of positioning and orientation of the burner axes insures that no molten, semi-molten, or solid aluminum metal is blown by the burner flames across the furnace and into the burners or burner openings on the opposite furnace wall, but rather falls upon the sloped hearth in a molten state and rapidly flows to the outlet trough toward the furnace taphole.

The outlet trough is preferably cast integrally with the concave portion of the hearth, and has a generally V-shaped cross-section with a flat bottom disposed at the apex of the V and extending lengthwise of the trough. The trough surfaces intersect the downwardly sloping conical hearth surfaces, and are constructed to form a smooth, somewhat convex transition between the trough and the concave hearth. The trough is sloped downwardly from the hearth at an angle of approximately 15° and the flat bottom of the trough extends in an inclined plane up to the center of the hearth and the axis of the cylindrical shaft and, thus, provides a launder-like portion in which molten aluminum flows smoothly and rapidly from the center of the hearth to the taphole. The radially outermost end of the outlet trough turns at right angles and leads to the taphole of the furnace. Typically, during aluminum melting operations, a "skin" of solidified aluminum and aluminum oxide forms over the flat bottom of the outlet trough from the hearth to the taphole and the molten aluminum flows beneath the solidified skin where it is advantageously protected from oxidation.

The furnace can be fired with either gaseous or liquid fuel, however, a gaseous fuel is preferred. One conventional burner suitable for use with the vertical shaft furnace of this invention is the burner disclosed in U.S. Pat. No. 4,301,997, which is assigned to the assignee of the present invention. A suitable apparatus and method for controlling the aforesaid burner are disclosed in the U.S. Pat. Nos. 4,239,191, and 4,211,555, respectively, both of which are assigned to the assignee of this invention. If a non-vaporized liquid fuel is used, the furnace of the invention may be operated according to the method and burner apparatus disclosed in U.S. Pat. No. 4,375,352, also assigned to the assignee of this invention. Although the aforementioned burners are particularly useful for melting copper, and, consequently, have a relatively high burner velocity, owing to the burner arrangement according to the present invention, it is possible to utilize such high velocity burners in the present vertical shaft furnace for melting aluminum and aluminum alloys.

With the foregoing and other objects, advantages and features of the invention that will become hereinafter apparent, the nature of the invention will be more clearly understood by reference to the following detailed description of the invention, the appended claims, and to the several views illustrated in the attached drawings.

DETAILED DESCRIPTION OF THE PREFERRED EMBODIMENT

Figure 1:
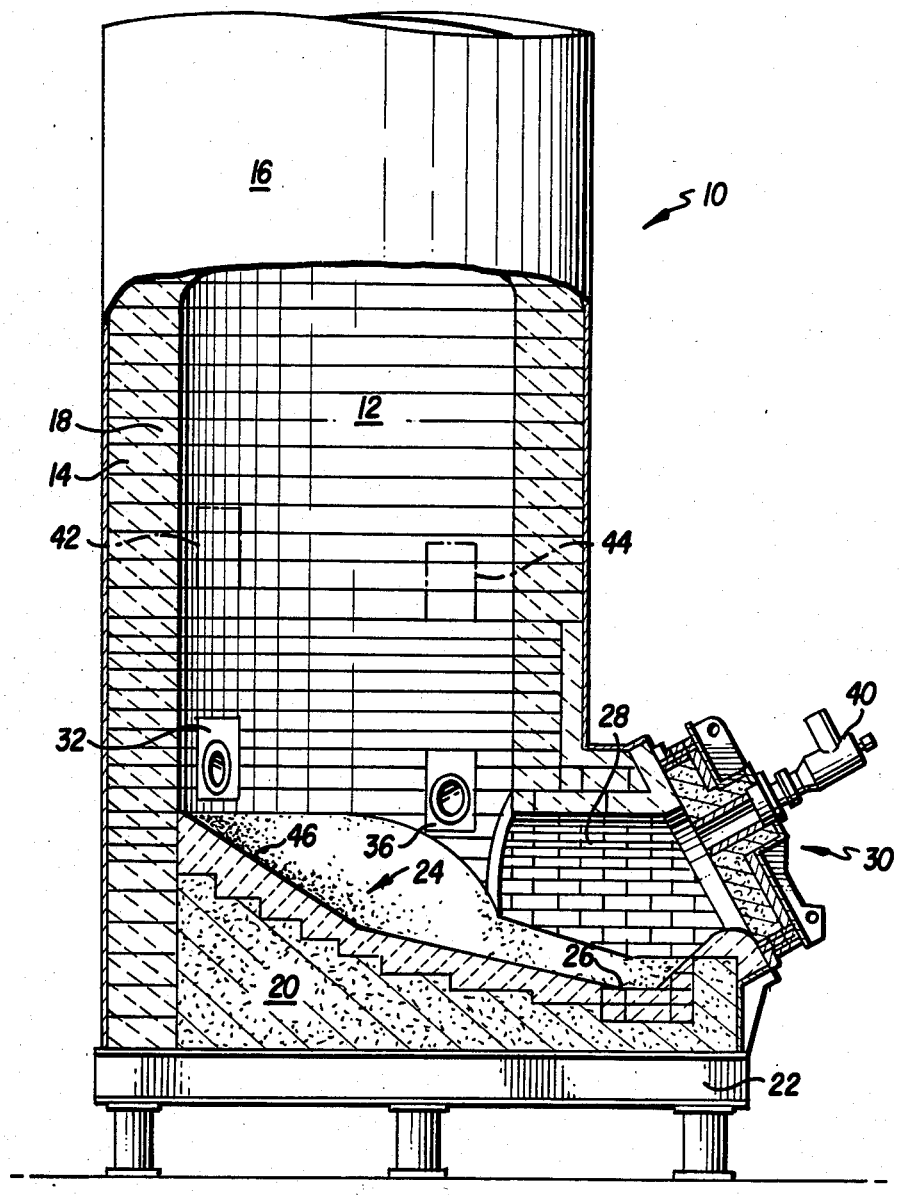
FIG. 1 is a side elevation view partly in section of the vertical shaft furnace used in the method of the present invention.

Referring now in detail to the drawings, there is illustrated in FIG. 1 a vertical shaft furnace for melting aluminum and aluminum alloys according to the invention, the furnace being designated generally by reference numeral 10. The furnace 10 is generally elongated, preferably cylindrical in shape, and defines an interior cylindrical melting chamber 12 which is adapted to be gravity-charged with aluminum in a conventional manner via an opening (not shown) in the upper portion of the furnace. The height of the furnace is determined based on the desired melting rate. Although the theoretical height of the furnace should be great enough to accomplish transfer of all heat energy to the metal charge, limitations of cost, furnace charging capabilities, and charge-to-furnace wall friction dictate a practical furnace height.

The furnace wall 14 comprises an outer, cylindrical, steel shell 16 with a composite refractory lining 18, and a layer of castable insulation (not shown) between the shell 16, and the refractory lining 18. Advantageously, refractory lining 18 is constructed of an innermost layer of a suitable refractory material, such as, for example, silicon carbide brick backed by heavy-duty firebrick. Any suitable refractory lining may be utilized so long as it is capable of withstanding high temperatures in the melting chamber and the friction generated between the lining and the metal charge.

The furnace 10 has a floor 20 also formed of a refractory brick material and is supported on a steel base 22. The furnace hearth 24 is formed of a castable, refractory material and has a generally concave configuration sloping toward an integrally formed outlet trough 26 as described in greater detail hereinafter.

An access tunnel 28 having an arcuate roof is interconnected with the melting chamber 12 of the furnace and is situated over the outlet trough 26. The tunnel 28 is also lined with a suitable refractory material, such as silicon carbide brick, in the same fashion as the walls of the furnace shaft. The tunnel 28 is closed at its end remote from the furnace by an access door 30 which comprises a refractory material cast in a steel door frame.

In the embodiment described herein, the furnace is provided with five burners. Four burners 32, 34, 36, 38 (only burners 32 and 36 are shown in FIG. 1) are mounted in burner ports in the furnace sidewalls immediately above the hearth 24, and one burner 40 is mounted in the tunnel access door 30. The burners 32–40 are preferably fired with natural gas, and may be of the type disclosed in U.S. Pat. No. 4,301,997. For larger melting capacity furnaces, an additional row or rows of burners may be mounted in the furnace walls as illustrated by the row of burner ports 42,44 shown in phantom in FIG. 1.

Figure 4:
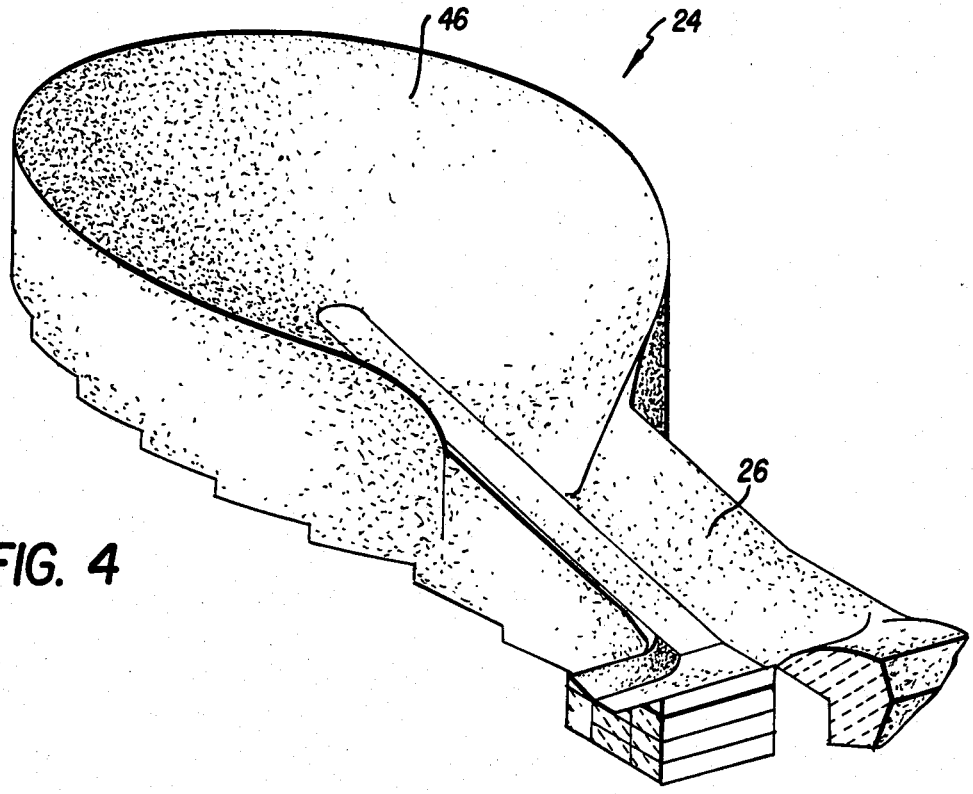
FIG. 4 is a perspective view showing the configuration of the hearth and outlet trough of the vertical shaft furnace used in the method of the invention.
Figure 5:
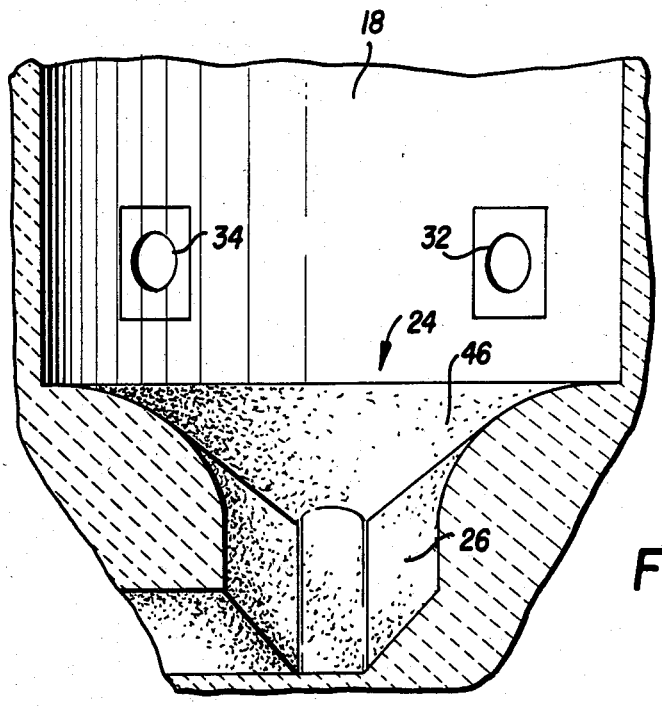
FIG. 5 is a fragmentary cross-sectional view showing the configuration of the hearth and outlet trough as viewed from the tunnel access door.

The configuration of the unitary refractory hearth 24 is shown in cross-section FIG. 1, in perspective view in FIG. 4, and in elevation in FIG. 5 as viewed from the access tunnel. The hearth 24 comprises a concave portion 46 formed in a generally conical shape, which is steeply sloped toward the furnace outlet trough 26. The concave portion of the hearth immediately beneath the burners 32, 34 has a conical slope or inclination of approximately 30° in the described embodiment, although such slope or inclination may vary from about 15° to about 45°. The concave portion of the hearth beneath the burners 36, 38 is generally conically shaped, but is curved downwardly and somewhat concavely toward the outlet trough 26 to form a smooth transition surface therewith.

Outlet trough 26 is preferably sloped downwardly along its centerline about 15° from approximately the center of the concave portion 46 and is formed into a right-angled bend toward the furnace taphole. As shown in FIG. 5, the outlet trough 26 comprises a generally V-shaped groove with a flat bottom that extends to the center of the furnace.

The above-described steeply sloping, concave configuration of the furnace hearth 24 and outlet trough 26 advantageously results in rapid flow of molten aluminum from all points on the hearth to the taphole hereby maintaining a "dry" hearth.

Figure 2:
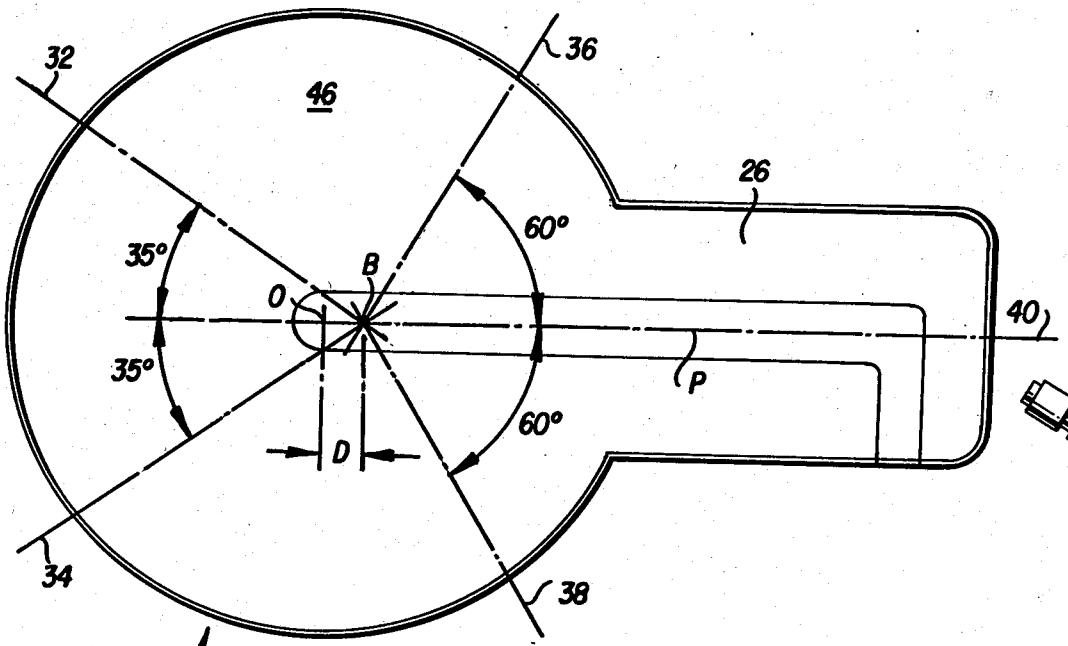
FIG. 2 is a schematic plan view showing the arrangement of the burners in the furnace.

Referring now to FIG. 2, there is illustrated the preferred arrangement of the burners 34–40 in the furnace 10. The axes of the two burners 32, 34 remote from the outlet trough, i.e., the back burners, are oriented at an angle of about 35° clockwise and counterclockwise, respectively, from a vertical plane P, which passes through the centerline of the outlet trough. The axes of the two front burners 36, 38, adjacent to each side of the outlet trough are oriented an an angle of 60° counterclockwise and clockwise, respectively, from vertical plane P. The axis of the burner 40 in the tunnel access door 30 is coincident with vertical plane P.

As shown best in FIG. 2, the intersection B of the planes containing the four burners 32–38 is offset from the vertical geometric axes O of the cylindrical furnace 10 by a distance D in the direction of the outlet trough 26. The amount of offset D may vary, but is preferably about 10–15% of the inside diameter of the furnace.

The combination of the angular orientation of the burners 32–38 and the offset D of the burner axes from the furnace axis O results in a net flow of hot burner gases toward the outlet trough, which advantageously helps to maintain the furnace hearth "dry" and improve the flow of molten aluminum toward the furnace outlet.

Figure 3:
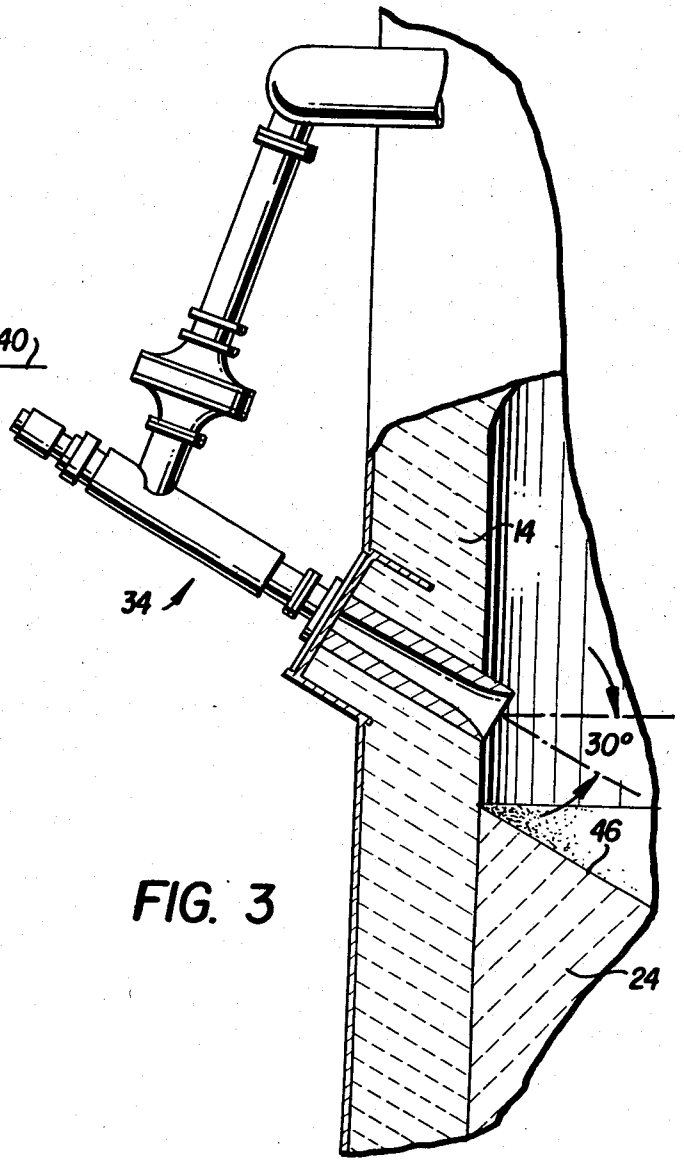
FIG. 3 is a fragmentary cross-sectional view showing a typical burner arrangement in the sidewall of the furnace.

FIG. 3 illustrates the substantial downward inclination of burner 34 which is typical of all burners 32–38 in the furnace wall 14. In the preferred embodiment, the inclination of each burner axis is about 30° and, thus, corresponds with the slope of that portion of the hearth disposed immediately beneath the burner. If the slope of the hearth differs from 30°, the inclination of the burner axes is preferably made to correspond to that slope to the greatest extent possible so that the axes of the burner flames will be maintained at a substantially constant distance from the hearth to promote uniformity of melting of the aluminum charge adjacent the hearth and thereby avoid hot spots and potential voids in the aluminum charge that may result from uneven melting.

As best seen in FIG. 1, the vertical location of the front burners 36, 38 and the furnace wall 14, is lower than that of the back burners 32, 34 by a distance which approximates the vertical drop of the hearth at the burner location owing to the steep slope of the hearth toward the outlet trough. By that construction, the flames of all the burners 32–38 are maintained at a substantially uniform height above the hearth.

A primary reason for the substantial downward inclination of the burners 32–38 is to prevent the low density aluminum or aluminum alloy metal being melted from being "blown" by the high velocity burner flames across the furnace and into a burner port on the opposite wall of the furnace. The combination of the non-equiangular disposition of the burners about the furnace wall and the downward burner inclination causes the burner flames to be directed at a respective opposing quadrant of the concave portion 46 of the hearth 24. Thus, the hearth forms a "backstop" for any molten, semi-molten, or solid aluminum metal "blown" across the furnace by high velocity gas impingement.

The burner 40 and the tunnel access door 30 is preferably downwardly inclined at a smaller angle than the burners 32–38, i.e., about 15° in the described embodiment, with a preferred range of 10° to 30°. One reason for orienting the burner 40 at a lower or less steep inclination than the burners 32–38 is to avoid any back-up in the flow of molten metal from the outlet trough caused by the flow of hot gases in a direction opposite to the flow of molten metal. Gas velocity of the burner 40 may also be adjusted to minimize any back-up of molten metal flow.

The primary purpose of the burner 40 is to maintain a high temperature in the tunnel and outlet trough. Advantageously, the burner 40 exhausts into the vertical shaft of the furnace and, thus, also transfers heat to the aluminum metal charge primarily by convection.

Although only a preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. A method of melting aluminum or aluminum alloys comprising the steps of:

charging a vertical shaft furnace having a hearth with aluminum or an aluminum alloy metal;

transferring sufficient heat to said aluminum or aluminum alloy metal substantially completely by convection to melt said metal, said heat transferring step including the step of directing the flames of a plurality of burners into the aluminum or aluminum alloy metal charge at the lower portion of said charge, said burner flames being downwardly inclined to impinge upon said hearth and being disposed in non-coincident vertical planes which intersect adjacent the axis of the vertical shaft furnace whereby blowing of molten, semi-molten or solid metal into said burners is prevented; and withdrawing the molten aluminum or aluminum alloy metal from the vertical shaft furnace.

2. The method according to claim 1, wherein the average heat input to said furnace is in the range of 600 to 1500 BTU per pound of aluminum or aluminum alloy melted.

3. The method according to claim 2, wherein the average heat input to said furnace is less than 1000 BTU per pound of aluminum or aluminum alloy melted.

4. The method according to claim 1, including the step of flowing the molten metal directly from the vertical shaft furnace to the outlet of the furnace without forming a bath or pool of metal.

5. A method of melting aluminum or aluminum alloys comprising the steps of:

providing a shaft furnace having a vertical axis and a concave hearth with a taphole for withdrawing the molten aluminum or aluminum alloy metal;

charging said shaft furnace with aluminum or an aluminum alloy metal;

transferring sufficient heat to said aluminum or aluminum alloy metal substantially completely by convection to completely melt said metal in said shaft furnace, said heat transferring step including the steps of directing the flames of a plurality of burners into the aluminum or aluminum alloy metal charge at the lower portion thereof, the axes of said burners being disposed in non-coincident vertical planes and downwardly inclined such that the flames thereof are directed to impinge upon regions on the concave hearth disposed opposite the respective burners whereby blowing of molten, semi-molten or solid metal into said burners is prevented, said vertical planes intersecting adjacent the axis of the shaft furnace to form a heating zone thereat, melting said charge with the heat from said heating zone which passes vertically upwardly through said charge to preheat and melt the charge substantially completely by convection;

flowing the molten metal directly from the hearth of the vertical shaft furnace to the taphole without forming a bath or pool of metal; and withdrawing the molten metal from the taphole of said furnace.

6. The method according to claim 5, wherein said hearth includes an outlet trough and wherein said flowing step includes the step of directing the net flow of hot burner gases toward the outlet trough.

7. The method according to claim 5, wherein the downward inclination of said burners is 15° to 45°.

8. The method according to claim 7, wherein the downward inclination of said burners is about 30°.

9. The method according to claim 6, including the step of directing the heat from one of said plurality burners in a direction parallel to and opposite the direction of flow of the molten metal in the outlet trough and at a downward inclination less than the downward inclination of the others of said plurality of burners.

* * * * *